US007013106B2

(12) United States Patent
Song et al.

(10) Patent No.: US 7,013,106 B2
(45) Date of Patent: Mar. 14, 2006

(54) LIQUID ELECTROPHOTOGRAPHIC IMAGE-FORMING APPARATUS HAVING ANTI-WRAPAROUND DEVICE FOR DEVELOPER REMOVAL

(75) Inventors: In-yong Song, Suwon-si (KR); Kwang-ho No, Gyeonggi-do (KR); Wan-ha Kim, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 98 days.

(21) Appl. No.: 10/743,544

(22) Filed: Dec. 23, 2003

(65) Prior Publication Data

US 2004/0184844 A1 Sep. 23, 2004

(30) Foreign Application Priority Data

Dec. 28, 2002 (KR) ..... 10-2002-0085912

(51) Int. Cl.
*G03G 15/16* (2006.01)

(52) U.S. Cl. ..... 399/297; 399/350

(58) Field of Classification Search ..... 399/162, 399/165, 297, 298, 302, 304, 343, 303, 308, 399/348, 350

See application file for complete search history.

(56) References Cited

U.S. PATENT DOCUMENTS 5,873,016 A * 2/1999 Kurokawa et al. ..... 399/297
6,898,403 B1 * 5/2005 Baker et al. ..... 399/249

* cited by examiner

*Primary Examiner*—Hoan Tran
(74) *Attorney, Agent, or Firm*—Roylance, Abrams, Berdo & Goodman, L.L.P.

(57) ABSTRACT

A liquid electrophotographic image-forming apparatus is provided including an anti-wraparound device having a bushing formed on both ends of a rotary shaft of a transfer backup roller to slide thereon, a shielding member installed on the bushing and contacting the transfer belt and the cleaning blade to prevent developer removed by the cleaning blade from flowing to the sides of the transfer belt, and an elastic member installed on both sides of the transfer backup roller for elastically biasing the bushing toward the transfer belt. Therefore, a wraparound phenomenon generated on the sides of the cleaning blade and transfer belt can be prevented, thus obtaining a higher image quality.

21 Claims, 4 Drawing Sheets

LIQUID ELECTROPHOTOGRAPHIC IMAGE-FORMING APPARATUS HAVING ANTI-WRAPAROUND DEVICE FOR DEVELOPER REMOVAL

CROSS-REFERENCE TO RELATED APPLICATIONS

This application claims priority under 35 U.S.C §119 to Korean Patent Application No. 2002-85912, filed in the Korean Intellectual Property Office on Dec. 28, 2002, the entire content of which is incorporated herein by reference.

BACKGROUND OF THE INVENTION

1. Field of the Invention

The present invention relates to a liquid electrophotographic image-forming apparatus, and more particularly, to a liquid electrophotographic apparatus including an anti-wraparound device for preventing developer removed from a transfer belt from flowing toward the sides of a cleaning blade and contaminating a main body of the apparatus.

2. Description of the Related Art

Generally, a liquid electrophotographic image-forming apparatus is an apparatus producing an image by charging a surface of an exposure medium using a charging device, forming an electrostatic latent image by exposing the exposure medium to light irradiated from a laser scanning unit according to a printing signal, and thereafter forming and transferring the image onto a printing medium using a transfer belt.

The liquid electrophotographic image-forming apparatus typically uses a contact charging method by which a predetermined electric potential is formed on the surface of the exposure medium through contact between the charging device and the exposure medium. A difference in electrical potentials created by the charging device is then used to attach the developer to the electrostatic latent image formed on the exposure medium, transfer the image from the exposure medium to the transfer belt, or transfer the image from the transfer belt to the printing medium.

However, the image may not be totally transferred from the exposure medium to the transfer belt, or from the transfer belt to the printing medium in all cases. When this occurs, a part of the image may remain on the exposure medium or on the transfer belt. Developer that remains on the transfer belt can then overlap with another image to be formed, thereby making it impossible to obtain a complete image. Therefore, a device is required to remove the remaining developer from the transfer belt. Several such devices for removing remaining developer from the transfer belt are disclosed in U.S. Pat. No. 5,873,016, U.S. Pat. No. 5,017,969, and Japanese Laid-open Patent No. 13-183951, the entire content of each is incorporated herein by reference.

The devices disclosed in the above patents use a cleaning blade to clean a transfer belt and remove remaining developer therefrom. The developer removed by the cleaning blade is stored in a container placed along the cleaning blade. However, since the removed developer has a high concentration, in some cases 20% to 30%, some of the developer flows toward the sides of the cleaning blade, thus contaminating the transfer belt. This phenomenon is referred to as a wraparound phenomenon. Consequently, the following image to be printed may be dragged by the transfer belt due to the excessive developer in a next transfer process.

Accordingly, a need exists for a device for preventing the developer removed by the cleaning blade from flowing toward the sides of the cleaning blade and contaminating the apparatus.

SUMMARY OF THE INVENTION

It is, therefore, an object of the present invention to provide a liquid electrophotographic image-forming apparatus including an anti-wraparound device which prevents developer removed by a cleaning blade from flowing toward the sides of the cleaning blade and contaminating a main body of the apparatus.

This and other objects are substantially achieved by providing a liquid electrophotographic image-forming apparatus including: an exposure medium on which an electrostatic latent image is formed by a laser scanning unit according to a printing signal; a developing device for developing an image by providing the electrostatic latent image formed on the exposure medium with a developer; a transfer belt to transfer the image formed on the developing device onto a printing medium; a cleaning blade for cleaning the developer remaining on the transfer belt; and an anti-wraparound device for preventing the developer removed by the cleaning blade from flowing towards the sides of the cleaning blade.

The anti-wraparound device includes: a bushing formed on both ends of a rotary shaft of a transfer backup roller and which can be slid along the axis of the rotary shaft yet fixed to prevent rotation; a shielding member surrounding each bushing and contacting the side of the transfer belt and the cleaning blade to prevent the developer removed by the cleaning blade from flowing toward the sides of the cleaning blade; and an elastic member installed on both ends of the rotary shaft of the transfer backup roller to surround the rotary shaft for elastically biasing the bushing toward the transfer belt. In the above anti-wraparound device, the transfer backup roller is installed to face the cleaning blade so as to interpose the transfer belt therebetween.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENTS

Figure 1:
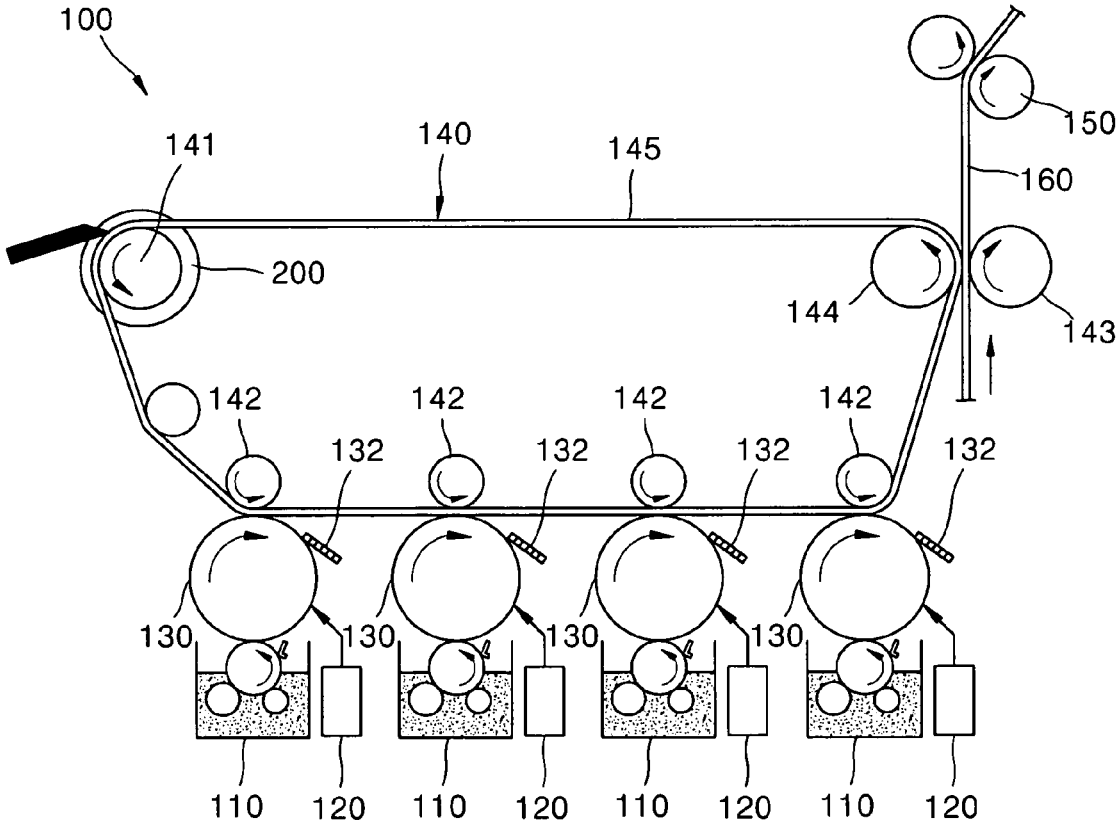
FIG. 1 is a schematic view of a liquid electrophotographic image-forming apparatus using an example anti-wraparound device in accordance with an embodiment of the present invention.

Referring to FIGS. 1 through 4, a liquid electrophotographic image-forming apparatus 100 is shown, wherein the apparatus includes a plurality of developing devices 110, a transfer device 140, a fixing device 150, a transfer belt cleaning blade 170, and an anti-wraparound device 200.

Each developing device 110 includes a developing roller, partially sunk in a container containing a single developer, which is rotated while contacting an exposure drum 130. The combination of developing devices 110 forms a desired image by overlapping four developers, that is, yellow, cyan, magenta, and black, on an electrostatic latent image formed on the exposure drums 130, respectively, by a light irradiated from the laser scanning units 120 according to an image signal.

The transfer device 140 includes a transfer belt 145 and a transfer roller 143. The transfer belt 145 is supported by a transfer backup roller 141, developing backup rollers 142, and a driving roller 144, and rotates in a closed loop to receive the image from the exposure drums 130. The transfer roller 143 is installed to face the driving roller 144, wherein the transfer belt 145 is interposed therebetween to transfer the image on the transfer belt 145 onto a paper 160. The fixing device 150 is installed on a paper delivery path to then fuse the image on the paper 160 by applying heat and pressure on the image transferred on the paper 160.

A number of exposure drum cleaning blades 132 are installed to contact the exposure drums 130 in order to remove the remaining developer from each exposure drum 130 which was not transferred onto the transfer belt 145. Additionally, the transfer belt cleaning blade 170 faces the transfer backup roller 141 and is installed to contact the surface of the transfer belt 145 in order to remove the remaining developer thereon. The remaining developer removed from the transfer belt 145 flows down along the cleaning blade 170 and is stored in a container (not shown). As noted above, an anti-wraparound device is also provided at this point to prevent developer removed by the cleaning blade 170 from flowing toward the sides of the cleaning blade and contaminating a main body of the apparatus.

Figure 2:
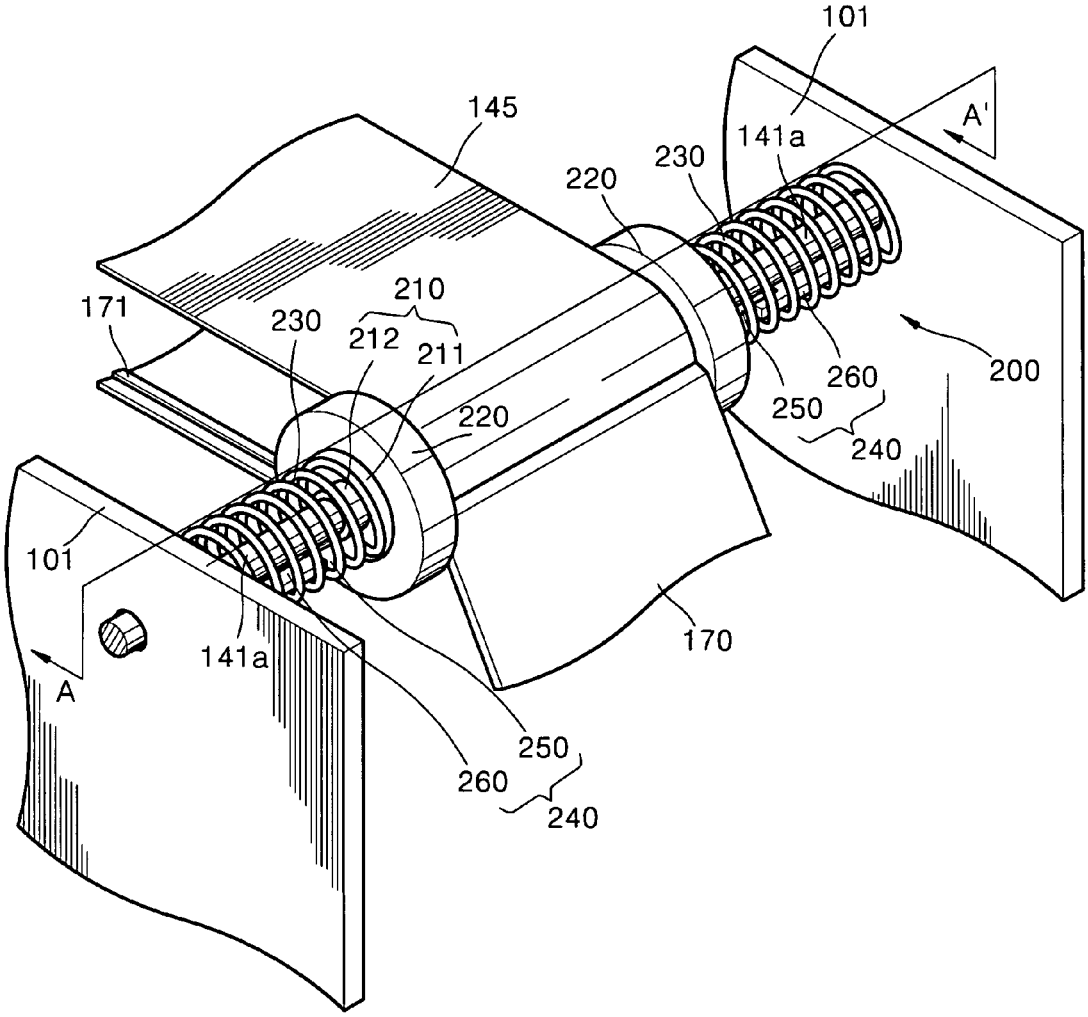
FIG. 2 is a perspective view of an example anti-wraparound device in accordance with a first embodiment of the present invention.

As shown in FIG. 2, the anti-wraparound device 200 includes a bushing 210, a shielding member 220, an elastic member 230, and a fix bushing member 240 formed on both ends of a rotary shaft 141*a* of the transfer backup roller 141. Each bushing 210 includes a body 211 having a cylindrical shape, installed on a rotary shaft 141*a* of the transfer backup roller 141 which is rotatably supported at each end by a bracket 101. Each bushing 210 is allowed to slide along the axis of the rotary shaft 141*a* and a supporting projection 212 is provided extending from the body 211 along the rotary shaft 141*a* to fix the bushing and prevent bushing rotation.

Figure 3:
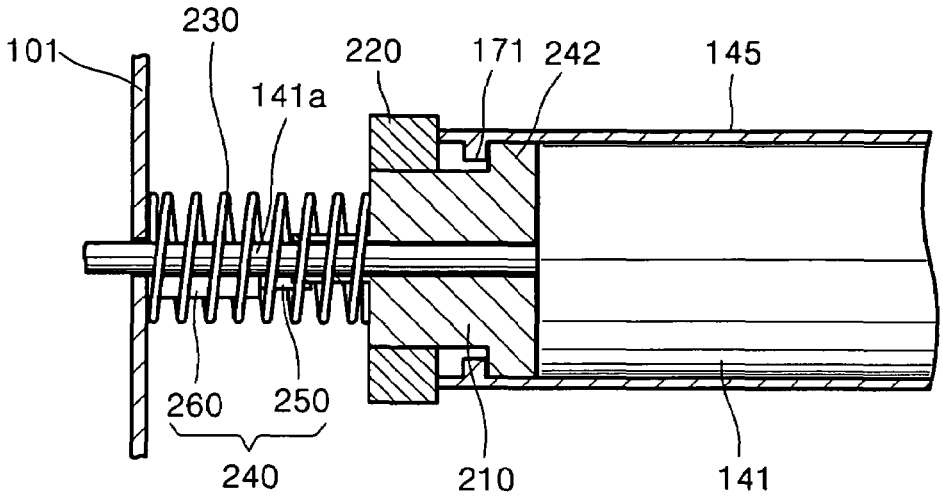
FIG. 3 is a partial cross-sectional view along cutting plane line A–A' in FIG. 2.

As shown in FIG. 3, the bushing 210 includes a pair of guide projections 242 for guiding the transfer belt 145 by contacting a transfer belt guide strip 171. The guide strip 171 is protrusively formed along both sides of the inner surface of the transfer belt 145 which contacts the transfer backup roller 141. Accordingly, the transfer belt 145 does not vibrate along the axis of the rotary shaft 141*a*.

Each shielding member 220 surrounds the body 211 of the bushing 210, and is installed so that a side surface of the shielding member contacts the side of the transfer belt 145 and the cleaning blade 170 to prevent the remaining developer removed from the transfer belt 145 from flowing along the cleaning blade 170 toward the sides of the cleaning blade 170, and from flowing toward the sides of the transfer belt 145.

Figure 4:
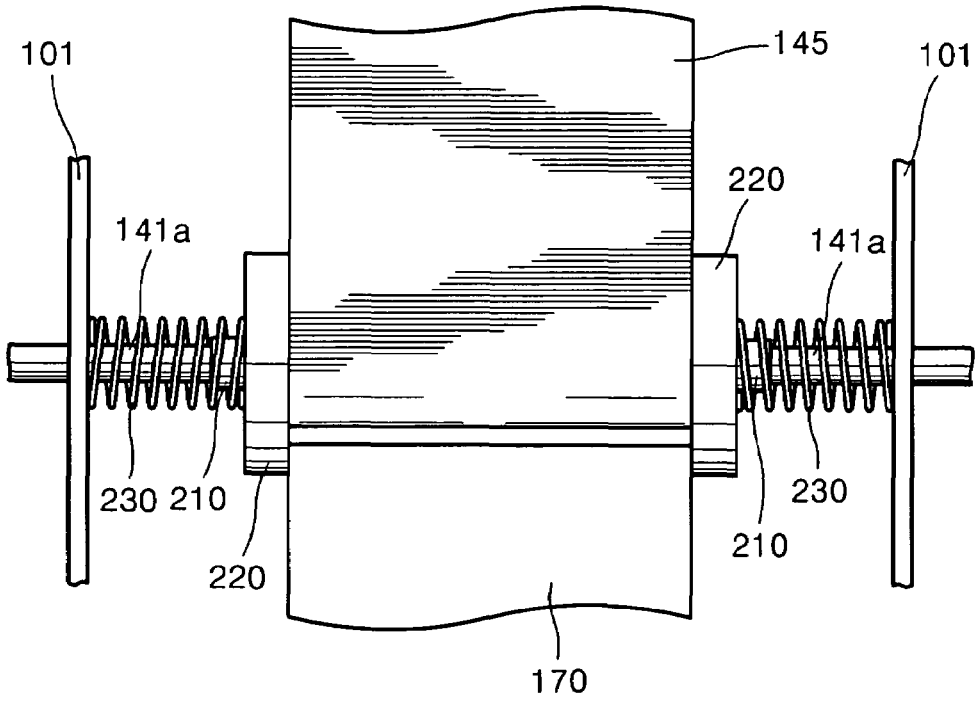
FIG. 4 is a plan view of the example anti-wraparound device shown in FIG. 2.

Therefore, in the embodiment shown in FIGS. 2, 3 and 4, the shielding member 220 is formed to extend in a radial direction from the rotary shaft 141*a* slightly above the contact point between the transfer belt 145 and the cleaning blade 170 to prevent the remaining developer from flowing toward the sides of the transfer belt 145 and the cleaning blade 170. In the embodiments of the present invention, the shielding member 220 is formed of a material which is softer than that of the transfer belt 145 or the cleaning blade 170 to minimize undesired abrasion generated due to the contact between the shielding member 220 and the transfer belt 145 and the cleaning blade 170. Therefore, in one embodiment of the present invention, the shielding member 220 can be made of sponge, rubber, or similar materials.

The elastic member 230 surrounds the rotary shaft 141*a* of the transfer backup roller 141, wherein one end of the elastic member 230 is supported by the bracket 101 and the other end is supported by a side surface of the bushing body 211. In such a position, each elastic member 230 maintains each bushing 210 against the ends of the transfer backup roller 141. Thus, the shielding member 220 is held closely against the side of the transfer belt 145 and the cleaning blade 170 to prevent the remaining developer removed by the cleaning blade 170 from flowing to the sides of the cleaning blade 170.

Figure 5:
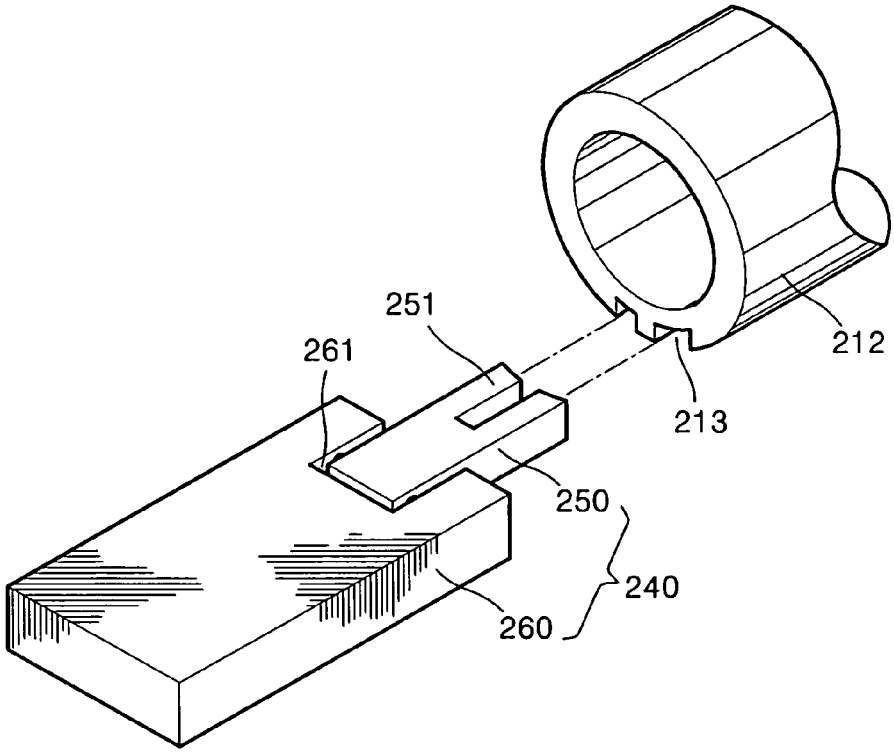
FIG. 5 is a perspective view of an example bushing fix member shown in FIG. 2.

FIG. 5 is a perspective view of an example bushing fix member shown in FIG. 2. Referring to FIG. 5, the bushing fix member 240 includes a stopper 250 and a supporting portion 260. On one end, the stopper 250 includes a plurality of protrusions 251 which are slidably inserted into a plurality of recesses 213 formed on the supporting projection 212 of the bushing 210. On a second end, the stopper 250 is inserted and fixed in a recess 261 of the supporting portion 260. One end of the supporting portion 260 is installed and fixed on the bracket 101, and the other end of the supporting portion 260 includes the supporting recess 261 for receiving and fixing the stopper 250 therein.

Therefore, the bushing 210 is fixed and is prevented from rotating by the bushing fix member 240 but allowed to slide along the rotary shaft. The bushing 210 is installed to slide along the axis of the rotary shaft 141*a* of the transfer backup roller 141, however, the shielding member 220 may also be rotated when the transfer backup roller 141 rotates due to friction between the shielding member 220 and the transfer belt 145. Since the bushing fix member 240 fixes the bushing 210, the bushing 210 does not rotate with the transfer backup roller 141.

Figure 6:
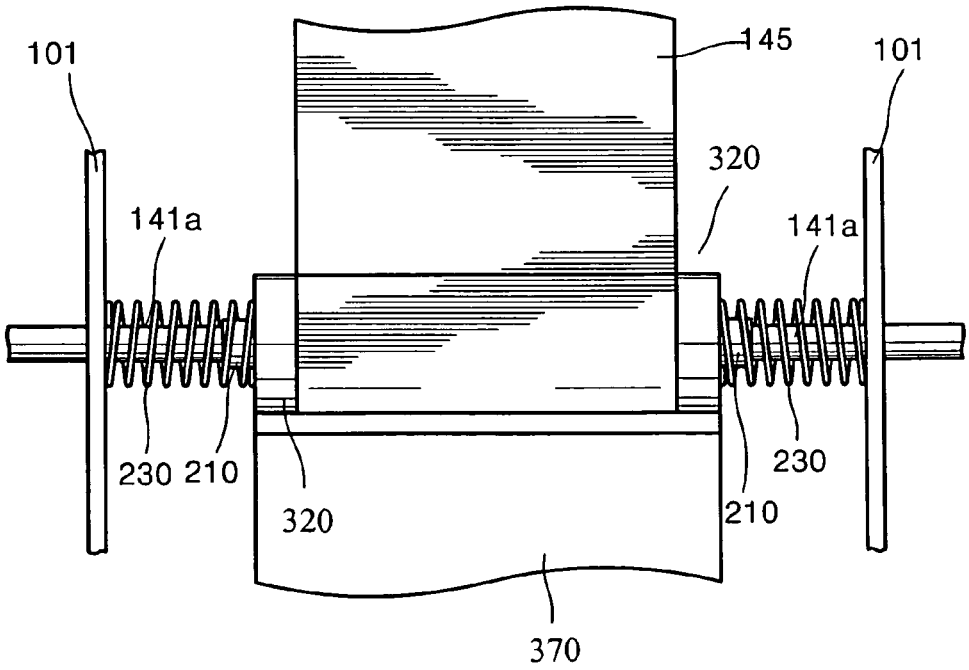
FIG. 6 is a plan view of an anti-wraparound device in accordance with a second embodiment of the present invention.

FIG. 6 is a plan view of an anti-wraparound device in accordance with a second embodiment of the present invention. Referring to FIG. 6, the anti-wraparound device of the second embodiment has a construction similar to that of the anti-wraparound device according to the first embodiment of the present invention shown in FIG. 4. However, in the second embodiment as shown in FIG. 6, the width of the cleaning blade 370 is larger than that of the transfer belt 145 such that the blade extends slightly beyond each side of the transfer belt. In addition, a shielding member 320 is installed to closely contact the sides of the transfer belt 145, but which does not contact the sides of the cleaning blade 370 as in the first embodiment.

In the second embodiment, even if the remaining developer removed from the transfer belt 145 by the cleaning blade 370 flows toward the sides of the cleaning blade 370, the shielding member 320 prevents the developer from flowing toward the sides of the transfer belt 145 and prevents the main body of the apparatus from being contaminated.

As described above, the embodiments of the present invention prevent a wraparound phenomenon from appearing on the sides of the cleaning blade and transfer belt, thereby allowing an image of high quality to be printed. While the invention has been shown and described with reference to certain embodiments thereof, it will be understood by those skilled in the art that various changes in form and details may be made therein without departing from the spirit and scope of the present invention as defined by the following claims.

What is claimed is:

1. A liquid electrophotographic image-forming apparatus comprising:

a transfer belt for transferring a developer image formed on an electrostatic latent image of a developing device onto a printing medium;

a cleaning blade for cleaning the remaining developer from the transfer belt; and an anti-wraparound device for preventing the developer removed by the cleaning blade from flowing toward both sides of the cleaning blade, wherein the anti-wraparound device comprises:

a bushing formed on both ends of a rotary shaft of a transfer backup roller to slide along the rotary shaft in an axial direction of the rotary shaft;

a shielding member, which is installed on the bushing and contacts the transfer belt and the cleaning blade to prevent the developer from flowing toward sides of the transfer belt; and an elastic member installed on both ends of the transfer backup roller to surround the rotary shaft for elastically biasing the bushing toward the transfer belt.

2. The apparatus of claim 1, further comprising:

a stopper fixing the bushing by being coupled to the bushing; and a bushing fix member, one side of which is fixed by a bracket and the other side of which includes a supporting portion for fixing the stopper.

3. The apparatus of claim 2, wherein the stopper includes a plurality of protrusions with predetermined intervals therebetween, and the bushing includes concave portions in which the protrusions are inserted.

4. The apparatus of claim 2, wherein the supporting portion includes a supporting recess in which the stopper can be inserted and fixed therein.

5. The apparatus of claim 1, wherein the bushing includes a guide projection for guiding the stable rotation of the transfer belt by contacting a guide strip which is protrusively formed along both sides of an inner surface of the transfer belt.

6. The apparatus of claim 1, wherein the shielding member is made of a material softer than that of the transfer belt.

7. The apparatus of claim 1, wherein the shielding member is made of a sponge material.

8. The apparatus of claim 1, wherein the shielding member is made of a rubber material.

9. The apparatus of claim 1, wherein the shielding member is formed having a diameter greater than a diameter of the transfer backup roller including a transfer belt thickness, and wherein the shielding member directs the developer removed by the cleaning blade away from the sides of the cleaning blade and the sides of the transfer belt.

10. The apparatus of claim 1, wherein the cleaning blade is formed to be wider than the transfer belt.

11. The apparatus of claim 1, wherein the shielding member is formed having a diameter substantially equal to a diameter of the transfer backup roller including a transfer belt thickness, and wherein the shielding member directs the developer removed by the cleaning blade away from the sides of the transfer belt.

12. An anti-wraparound device for preventing developer contamination, comprising:

a bushing formed on both ends of a rotary shaft of a transfer backup roller to slide along the rotary shaft in an axial direction;

a shielding member installed on the bushing and contacting a transfer belt and a cleaning blade to prevent developer from flowing toward the sides of the transfer belt; and an elastic member installed on both ends of the transfer backup roller to surround the rotary shaft for elastically biasing the bushing toward the transfer belt.

13. The device of claim 12, wherein the shielding member is formed having a diameter greater than a diameter of the transfer backup roller including a transfer belt thickness for directing the developer removed by the cleaning blade away from at least one surface of the transfer belt and the cleaning blade.

14. The device of claim 12, wherein the shielding member is formed having a diameter substantially equal to a diameter of the transfer backup roller including a transfer belt thickness for directing the developer removed by the cleaning blade away from at least one surface of the transfer belt.

15. The device of claim 12, further comprising:

a stopper fixing the bushing by being coupled to the bushing; and a bushing fix member, one side of which is fixed by a bracket and the other side of which includes a supporting portion for fixing the stopper.

16. The device of claim 15, wherein the stopper includes a plurality of protrusions with predetermined intervals therebetween, and the bushing includes concave portions in which the protrusions are inserted.

17. The device of claim 15, wherein the supporting portion includes a supporting recess in which the stopper can be inserted and fixed therein.

18. The device of claim 12, wherein the bushing includes a guide projection for guiding the stable rotation of the transfer belt by contacting a guide strip which is protrusively formed along both sides of an inner surface of the transfer belt.

19. The device of claim 12, wherein the shielding member is made of a material softer than that of the transfer belt.

20. The device of claim 12, wherein the shielding member is made of a sponge material.

21. The device of claim 12, wherein the shielding member is made of a rubber material.

* * * * *